United States Patent [19]

Rosen

[11] 4,004,620

[45] Jan. 25, 1977

[54] FLUID FILLING MACHINE

[76] Inventor: Sidney Rosen, 4119-27 Fordleigh Road, Baltimore, Md. 21215

[22] Filed: Oct. 4, 1974

[21] Appl. No.: 512,351

[52] U.S. Cl. ..... 141/137; 141/138; 141/179

[51] Int. Cl.[2] ..... B65B 43/56

[58] Field of Search ..... 141/94, 98, 134, 135, 141/137, 140, 141, 155–162, 177–180, 181, 234, 237, 263, 270, 378, 138, 167, 183; 198/34 A, 40

[56] References Cited

UNITED STATES PATENTS

| | | | |
|---|---|---|---|
| 1,826,926 | 10/1931 | Cundall | 141/181 X |
| 2,574,595 | 11/1951 | Shaw | 141/155 X |
| 2,785,706 | 3/1957 | Ryan, Jr. et al. | 141/137 X |
| 3,100,513 | 8/1963 | Cozzoli et al. | 141/137 X |

*Primary Examiner*—Richard E. Aegerter
*Assistant Examiner*—Frederick R. Schmidt
*Attorney, Agent, or Firm*—Craig & Antonelli

[57] ABSTRACT

A filling machine for simultaneously filling several containers each with a predetermined amount of fluid, in which the containers are indexed by the use of a feed screw which moves the containers into the area of the machine where the nozzles are lowered into the containers to carry out the discharge of the fluid into the containers and are raised again, and/or in which the nozzle support structure is actuated to reciprocate in the direction of the movement of the containers while the containers are being filled and opposite this direction after the nozzles are raised clear of the top of the containers.

19 Claims, 4 Drawing Figures

FLUID FILLING MACHINE

The present invention relates to fluid-handling and filling machines, and more particularly to a novel indexing and control system for use in such automatic filling machines.

Various types of filling machines for accurately filling containers, such as bottles with a predetermined amount of fluid are known in the prior art. For example, my prior U.S. Pat. Nos. 3,067,786 and 3,237,661 describe such fluid-handling and filling machines. However, it is disadvantageous with these prior art filling machines that complicated mechanical-electrical systems are required to properly index the containers, i.e., to assure that the proper number of containers are moved into correct position underneath the corresponding number of filling nozzles, are held thereat while the nozzles are lowered into the containers, and are then again properly released for further handling after the filling operation has been completed, while the corresponding number of empty containers is permitted to move into position again underneath the filling nozzles for the next filling cycle. Normally, the prior art indexing mechanisms consist of mechanical members adapted to project into the path of movement of the containers which are selectively moved into the path of containers to stop the containers and more retracted again to release the further movement of the containers. Such mechanical members are normally necessary both at the discharge end of the filling station and at the infeed end. Additionally, the prior art indexing mechanisms require mechanical sensors or the like to assure the presence of the predetermined number of containers at the filling station, to avoid spilling of the fluid in the absence of one container each underneath each filling nozzle. To control the indexing system, relatively complicated electrical control devices are required in the prior art which cooperate with the mechanical members to achieve the requisite control and indexing. Apart from the costs involved in this relatively complex control system, the prior art electromechanical control systems which involve a relatively large number of parts and control relays as well as solenoids, not only are prone to troubles but more importantly entail considerable disadvantages as regards lack of flexibility.

Another disadvantage in the prior art systems is the fact that the containers such as bottles are moved into position by a continuously running conveyor which continues to operate even while the bottles are held stationary by the mechanical members during the actual filling operation. This requires slippage between the bottom of the containers and the conveyors while the containers are being filled, thus making certain requirements as to the materials which can be used and involving the danger of possibly tipping over or misalignment of the containers. Furthermore, the electromechanical control and indexing systems of the prior art place certain limitations on the size and shape of the containers which can be efficiently handled thereby. Additionally, the projecting fingers, stop members, or the like always represent a source of possible damage to the containers.

Accordingly, it is an object of the present invention to provide a novel container filling system which avoids by simple means the aforementioned shortcomings and drawbacks encountered in the prior art.

Another object of the present invention resides in a container filling system which exhibits an improved method for indexing containers on a conveyor line and which is characterized by greatly improved flexibility of the system.

A further object of the present invention resides in an indexing and control system for a container filling machine which causes the containers to be positively moved into and out of the filling station in a straight line with a positive non-slip motion.

Still another object of the present invention resides in a container filling system provided with a novel indexing mechanism which not only permits a significant increase in the production rate but which also permits the handling of stable as well as unstable containers with equal facility.

Still a further object of the present invention resides in a container filling system of the type described above in which slippage between the container and the feed mechanism is substantially eliminated, thereby permitting higher speeds of operation.

Another object of the present invention resides in an indexing system for filling machines which is capable of handling unstable as well as odd-shaped containers without difficulties while assuring proper indexing of and spacing between such containers.

Still another object of the present invention resides in an indexing system for filling machines which dispenses with the use of finger-like members projecting into the path of movement of the containers and which excels by its simplicity of structure and versatility with respect to the number of containers to be filled and the amounts to be filled into each container with the same pump system.

The container filling system in accordance with the present invention utilizes a novel timing screw indexing system which includes a feed screw shaped to fit the containers. The containers are transported to the infeed point of the feed screw by the conveyor whereupon the feed screw engages the containers and moves the same into position underneath the filling nozzles while rotating a predetermined number of times as determined by the setting of a digital-type electronic counter which also controls the start and stop of the feed screw. After the feed screw has rotated the predetermined number of times, it is stopped by the electronic control counter whereupon the filling nozzles descend into the containers and thereafter rise again as the bottles are filled from the bottom up to avoid the formation of bubbles. When the nozzles clear the top of the containers, the feed screw again resumes its rotation as a result of the closing of a switch by the pump shaft in the position of the latter corresponding to the beginning of the suction stroke. This rotation causes the feed screw to simultaneously remove the filled containers from the filling position onto a conveyor and to move the next set of unfilled containers into position underneath the nozzles. The feed screw is thereby programmed by the digital-type electronic counter which presets the number of revolutions of the feed screw and the number of containers indexed under the filling nozzles during each cycle. In addition to the electronic SCR drive which controls the rotational speed of the feed screw and synchronizes the rotation with the discharge from the filling units, a safety system is also provided which immediately detects the absence of a properly positioned container and stops the system in the event a container is tipped over or is not present.

Furthermore, the safety system also detects the back up of bottles at the discharge end and stops the machine in case of such back up.

In another embodiment according to the present invention, a walking beam structure for the nozzle support is used which moves the nozzle assembly in the direction of movement of the containers and at the same speed as the latter while filling the containers, and thereupon returns the filling nozzles of the nozzle assembly in the opposite at a faster rate to the original position where the nozzles are again lowered into the next set of empty containers so that the feed screw does not have to be stopped at all. This walking beam filler arrangement which may also be used to advantage with any other indexing systems, such as described in my aforementioned patents, obviates the need for stopping the movement of the containers while being filled, for example, by stopping the rotation of the feed screw or by utilizing stop fingers, thereby resulting in an increased production rate.

In still another embodiment of the present invention, the production rate is further increased by utilizing two conveyor paths arranged parallel to one another with the filling mechanism disposed therebetween, whereby each conveyor path includes at least one indexing feed screw.

The indexing feed screws of this invention may be readily exchanged for indexing feed screws of different shape, so that the filling machine can be used in connection with containers of the most varied types and shapes. Thus, for example, the present invention is not limited to filling containers in the form of typical round bottles but can also be used by suitable design of the feed screws for filling relatively flat containers of rectangular shape and having a hinged hood. By the use of appropriate camming members, the hinged hoods of the containers are thereby automatically opened to enable the filling thereof and thereafter are closed again after completing the filling operation whereby cam surfaces, such as fingers and/or spring-loaded wheels may be used to exert pressure on the hinged hoods to close the same tightly shut.

Moreover, while the use of a single feed screw with an appropriate complementary surface formed, e.g. by a backing plate which may possibly be adjustable to accommodate different container sizes, is adequate in many cases, the operation may be still further improved by the use of two feed screws having helices in opposite directions and rotating in opposite directions which define therebetween the space for the containers.

These and other objects, features and advantages of the present invention will become more apparent from the following description when taken in connection with the accompanying drawing which shows, for purposes of illustration only, several embodiments in accordance with the present invention, and wherein.

Figure 1:
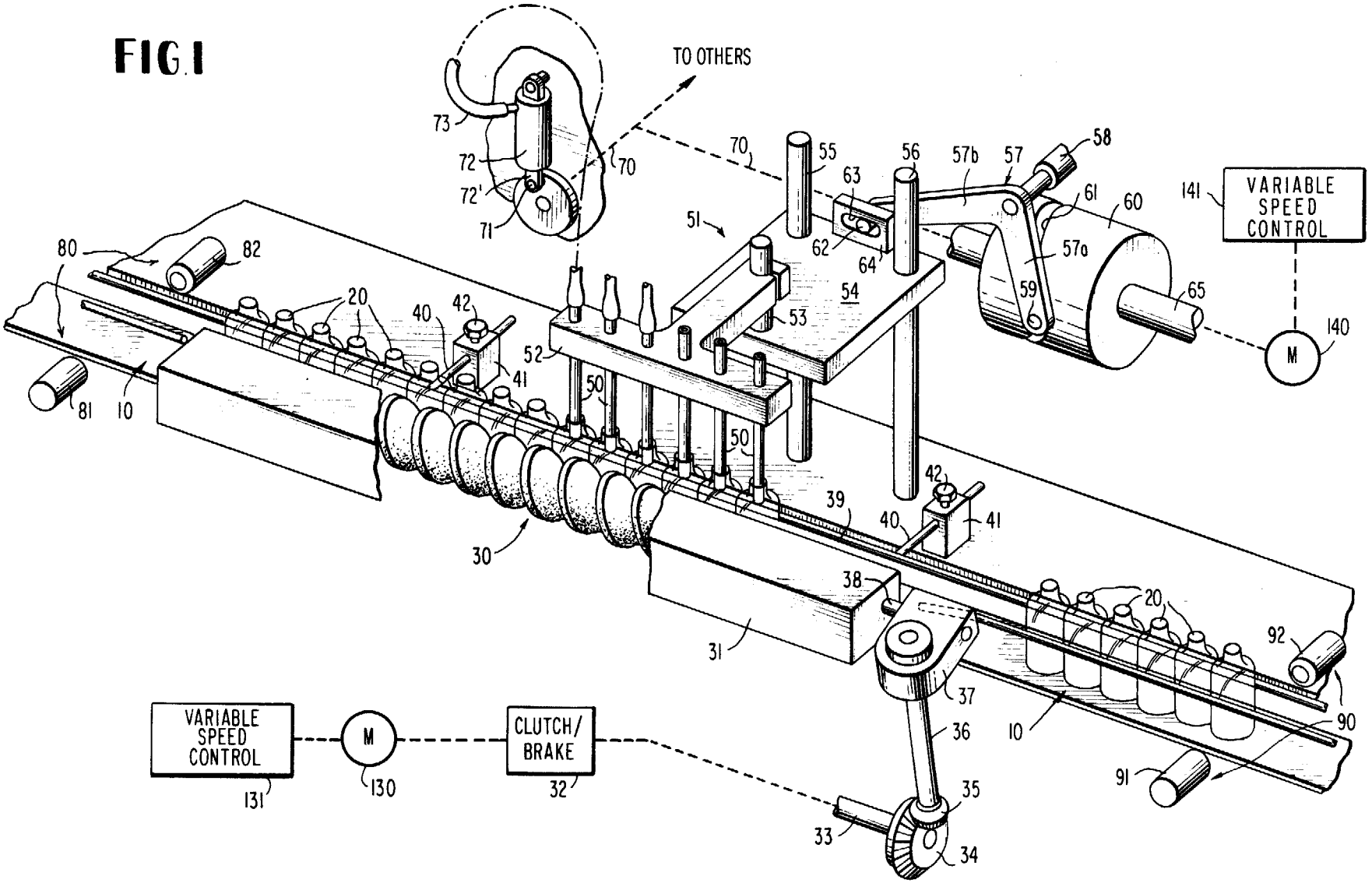
FIG. 1 is a somewhat schematic partial perspective view of a filling machine with a screw feed indexing mechanism in accordance with the present invention.

Referring now to the drawing wherein like reference numerals are used throughout the various views to designate like parts, reference numeral 10 generally designates an endless conveyor of conventional construction for conveying containers, for example, in the shape of bottles 20. The conveyor is driven by a suitable drive means, for example, in the form of an electric motor 110 (FIG. 2) by way of a conventional conveyor motor controller generally designated by reference numeral 120 and including a variable speed control 121 of conventional type. However, in the alternative, also a hydraulic drive may be used for the conveyor 10. The containers 20 (FIG. 1) are fed by the conveyor 10 to the point of infeed of the indexing mechanism in accordance with the present invention which includes a feed screw generally designated by reference numeral 30 of a design matched to the containers to be transported thereby. The feed screw 30 which is housed within a housing 31 is thereby rotated from an electric motor 130 (FIGS. 1 and 2) with a conventional speed control 131, by way of a speed reducer (not shown), a conventional clutchbrake 32 (FIG. 1) which is electrically controlled in a manner to be described more fully hereinafter, and a suitable chain and sprocket drive (not shown) driving a shaft 33 which by way of bevel gears 34 and 35 transmits the drive by way of a shaft 36 and further gears (not shown) arranged within the housing 37 to the worm shaft 38. The worm 30 which is securely connected with the worm shaft 38 thereby cooperates with a complementary surface formed, for example, by a suitably shaped back plate 39 in the form of an upright wall or the like to define the space for the containers. The guide wall 39 may thereby be adjustable by means of rods 40 extending through a fixed suppport member 41 where they are clamped in place by suitable clamping means 42. This enables the space for the containers to be adjusted in width. Furthermore, the feed screws 30 are readily interchangeable by opening or removing the housing 31 so that the filling machine in accordance with the present invention may be adapted to containers of the most varied shapes.

The filling machine, as such, may be of any conventional construction, such as described in my aforementioned patents and includes the usual standard or frame, on which the various parts that are normally covered by a housing (not shown) are mounted. More specifically, the filling machine includes several filling nozzles 50, in the instant machine, six such filling nozzles. These nozzles are held in a nozzle support generally designated by reference numeral 51 which includes a T-shaped support member 52 detachably clamped to an upright support pin 53 fixedly mounted on a support table 54 which is adapted to slide in the vertical direction along guide rods 55 and 56 extending through corresponding bores in the table 54. The vertical movement of the nozzles 50, in turn, is obtained by means of a bell crank generally designated by reference numeral 57 which is mounted on the machine frame at 58 for pivotal movement and engages in a guide groove 61 provided in a cam 60 by means of a guide pin 59 mounted at the bell crank 57 near the end of one arm **57*a* thereof. The other end of the other arm 57*b* of the bell crank 57 is provided with a guide pin 62 engaging in an elongated opening 63 formed in a corresponding guide member 64 fixedly mounted on the table 54. The cam 60 is rotated by means of a shaft 65 which may be integral with the pump shaft 70 or may be suitably connected thereto. The shaft 65 as well as the pump shaft 70 are suitably rotated from a filler motor 140 with a conventional speed control 141. The guide groove 61 in cam 60 is thereby of such configuration that the filling nozzles 50 are lowered and raised as the bell crank 57 rotates counterclockwise and clockwise, respectively, as a result of the follower engagement of guide pin 59 in groove 61 so as to ensure thereby that the nozzles 50 are lowered at the proper instant into the containers 20 to be filled and then are raised while the filling operation continues until they are completely raised out of the containers after the latter have been completely filled. One pump 72 is provided for each nozzle 20 which are of any conventional construction, for example, as described in my prior U.S. Pat. Nos. 2,807,213 and 2,907,614. The piston rods 72' are thereby reciprocated by the drive connection of any conventional type, for example, utilizing eccentrics 71 which are mounted on the common pump shaft 70. Each pump 72 is also connected by way of a line 73 with the respective nozzle 50**, only one such pump and line connection being shown schematically herein for the sake of simplicity.

In order to detect the presence of the continued feed of empty containers 20, a photoelectric gate mechanism generally designated by reference numeral 80 is provided at or upstream of the infeed point which includes a light source 81 and a photoelectric cell 82 with associated control circuit including an amplifier connected thereto which causes the motor 140 to stop to rotate if the gate mechanism 80 detects the continued presence of a light beam from the light source 81 for a predetermined length of time, thereby indicating the absence of a container. Since the elements 80 and 81 including the circuits connected to the photoelectric cell are of conventional construction involving commercially available items, a detailed description thereof is dispensed with herein.

A back-up of bottles, for example, at the capping machine which is connected at the downstream end of the conveyor 10 will be detected by another photoelectric gate mechanism generally designated by reference numeral 90 which again includes a light source 91 and a photoelectric cell and control circuit 92. The gate control 90 will thereby stop the motor 140 if the light beam emitted from the light source 91 continues to be interrupted for a predetermined length of time, i.e., if a back-up or jam-up of bottles occurs at that point. Again, since the elements 91 and 92 and their circuits are of conventional construction involving commercially available items, a detailed description thereof is dispensed with herein.

Figure 2:
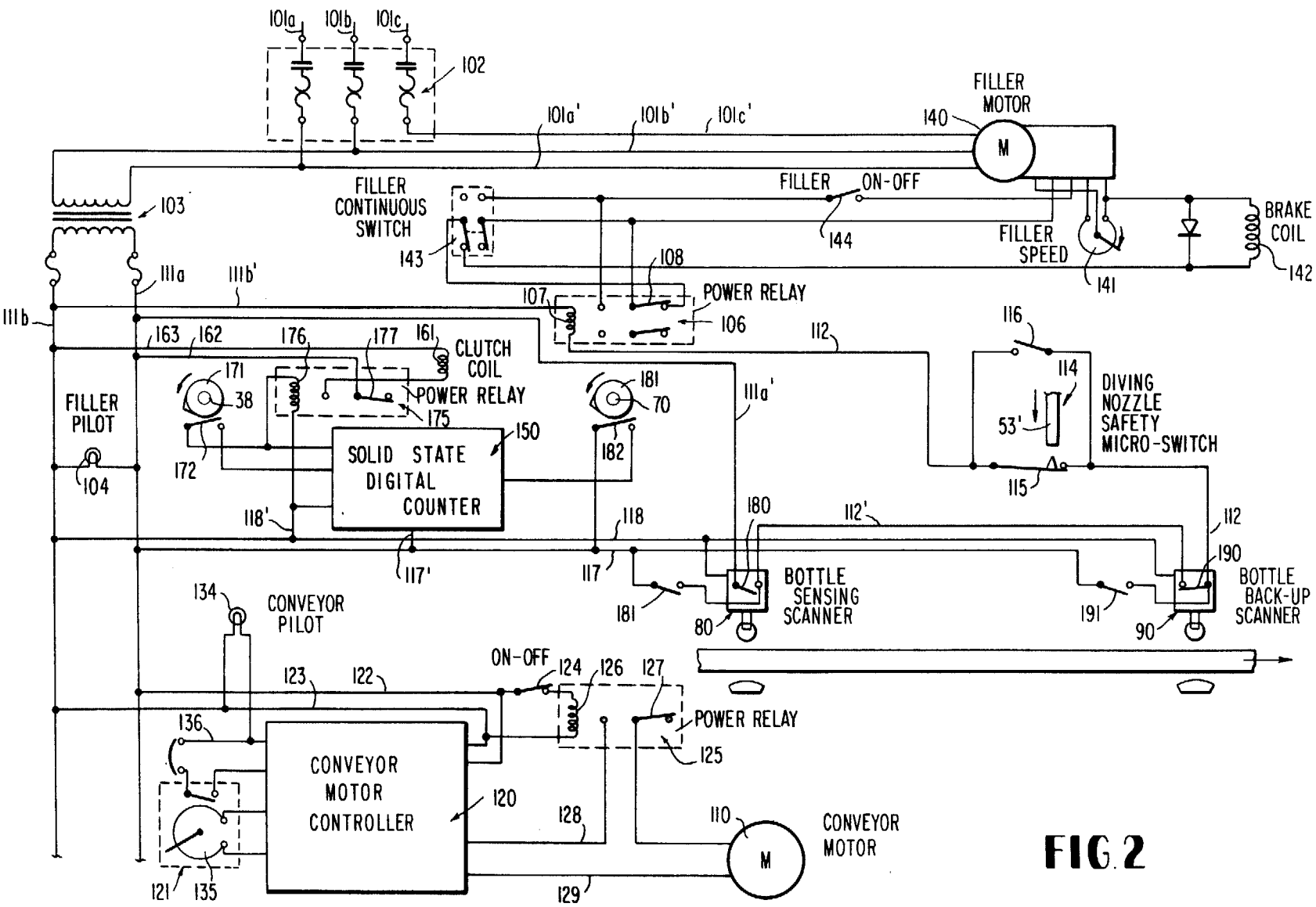
FIG. 2 is a schematic diagram of the control system for use with the filling machine of FIG. 1.

FIG. 2 illustrates a typical circuit diagram for a control system which can be used with the filling machine of FIG. 1. More particularly, a three-phase power line 101*a*, 101*b* and 101*c* is connected with the main switch generally designated by reference numeral 102 of conventional constructin. The filler motor 140 which is a conventional AC motor is connected with the main switch 102 by way of lines 101*a'*, 101*b'* and 101*c'*. Since the power line voltage is, for example, 480 volts, a transformer generally designated by reference numeral 103 which is connected with the lines 101*a'* and 101*b'* provides in its output a source of voltage of 115 volts to permit the use of commercially available motors and control components. A filler pilot light 104 is connected across the two lines 111*a* and 111*b* connected to the secondary winding of the transformer 103, for example, by way of fuses to indicate power for the filling circuit. The power relay generally designated by reference numeral 106 includes a coil 107 connected at one end with line 111*b* by way of line 111*b'* and a double pole, double throw switch 108 controlled by the coil 107. The other side of the coil 107 is connected by way of a line 112 with a diving nozzle safety microswitch generally designated by reference numeral 114 whose microswitch 115 is actuated by an actuating element 53' forming part of the vertically moving nozzle structure and detecting any obstruction in the vertical movements of the nozzle support structure 52, 53, 54 (FIG. 1), to thereby stop the motor 140 when such obstruction occurs. An on-off by-pass switch 116 is connected in parallel with the safety microswitch 114 to permit bypass of the latter. Also connected in series with the microswitch 114 in line 112 are the photoelectric bottle back-up scanner generally designated by reference numeral 90 and the photoelectric bottle-sensing scanner generally designated by reference numeral 80. The switch 190 of the scanner 90 thereby remains closed as long as the light beam from the source 91 is not interrupted for a predetermined length of time, for example, due to a back-up of bottles. Switch 190 is connected by way of a line 112' with the switch 180 of the gate control 80 which remains closed as long as the light beam emitted by the light source 81 continues to be interrupted at predetermined intervals of time, thereby indicating the presence of a bottle. The other side of the contact 180 is then connected by way of line 111*a'* with the line 111*a* of the secondary side of the transformer 103. Bypass switches 181 and 191 thereby provide an effective bypass of the photoelectric safety devices 80 and 90 respectively to permit the operator to continue to operate the filling machine, for example, in case of a failure in the photoelectric system thereof so as not to require a shutdown of the machine until the photoelectric systems can be repaired. At the time switch 181 and/or 191 is closed, the proper operation of the machine can be supervised by a person. Lines 117 and 118 connected with the lines 111*a* and 111*b* thereby provide the power for operating the photoelectric scanners 80 and 90.

The conveyor motor 110 is also energized from the secondary transformer 103 by way of lines 122 and 123 connected with lines 111*a* and 111*b*, respectively. The conveyor on-off switch 124, upon being closed, is operable to cause energization of the coil 126 in the power relay generally designated by reference numeral 125 which includes a single throw double-pole contact 127 controlled by the relay coil 126; upon energization of coil 126, the contact 127 closes the line 128 of the two lines 128 and 129 connecting the conveyor motor 110 with the conveyor motor controller 120. The conveyor motor controller 120 is of conventional construction and includes a potentiometer 135 in the speed control 121. A conveyor pilot light 134 is connected across lines 122 and 136 to indicate the presence of power in the conveyor motor control.

The solid state digital counter generally designated by reference numeral 150 which is a commercially available ATC counter, for example, of the type 336B manufactured by Automatic Timing and Controls is connected by way of lines 117' and 118' with lines 117 and 118 and therewith with lines 111*a* and 111*b* of the secondary winding of the transformer 103. The electromagnetically actuated clutch brake mechanism generally designated by reference numeral 32 (FIG. 1) includes a clutch coil 161 (FIG. 2) which upon energization engages the clutch and thereby establishes a driving connection between the motor 130 and the drive connection 33, 34, 35, 36 and 37, driving the worm shaft 38. Mounted on the worm shaft 38 is a cam 171 which closes a microswitch 172 everytime the worm shaft completes one revolution. Closing of the microswitch 172 produces a pulse which is fed to the counter 150 whereby the latter counts the number of these pulses and therewith the revolutions completed by the worm shaft 38. Once the preset number of revolutions has been completed, the counter 150 will control the single pole double throw power relay generally designated by reference numeral 175 by causing its coil 176 to become de-energized and thereby opening the energizing circuit 162, 163 for the clutch coil 161 by way of its single pole switch 177, whence the worm shaft 38 is stopped by the brake mechanism in clutch-brake unit 32. Of course, the motor 130 and its control circuits may include other conventional components such as an on-off switch, a circuit breaker, etc.

A second cam 181 is mounted on the pump drive shaft 70 or on shaft 65 and closes a microswitch 182 everytime the pump shaft has rotated to the point where is reaches the beginning of the suction stroke—at which time the nozzles have been raised again clearing the containers 20—in order to thereby cause the counter 150 to re-energize the coil 176 in order to start again rotation of the worm shaft 38 by energization of the clutch coil 161. Since the motor 130 need not be de-energized during an operating cycle, and since its controls are conventional, a showing thereof has been dispensed with in FIG. 2 for the sake of simplicity.

The variable speed filler motor 140 is controlled by a speed control mechanism of conventional type including a filler speed potentiometer 141, an on-off switch 144, a brake coil 142 being also provided so as to stop the motor 140 promptly and accurately once the power to the motor 140 is de-energized by power relay 106. A continuous switch for the filler mechanism which is designated by reference numeral 143 is also provided for selectively controlling continuous operation.

As mentioned above, the various electrical components for the control system are of commercially available type and are therefore not described in detail herein.

OPERATION

For purposes of operating the filling machine, the counter 150 is set initially to the predetermined number which is to correspond to the number of bottles to be filled simultaneously. Assuming that the filling machine includes six filling nozzles and that six bottles are to be filled simultaneously as shown in FIG. 1, the counter 150 is set to six. The filling station is then filled manually with six containers 20 and the main switch 102 is thereupon closed which will cause the power relay 125 to close the energizing circuit of the conveyor motor 110 whose speed is determined by the adjustment of the speed potentiometer 135. The light 134 will indicate that power exists at the conveyor motor 110 which upon energization will cause the conveyor 10 to start moving the containers to the feed position of the feed screw 30. The bottle sensing scanner 80 will thereby keep switch 180 closed as long as there is a continuous feed of bottles while microswitch 190 will continue to stay closed as long as there is no bottle back-up. As a result thereof, the power relay 106 for the variable speed filler motor 140 will also close the energizing circuit for the latter so that the motor 140 starts to rotate.

Rotation of the motor 140 will start to rotate the shaft structure 65, 70 so that both the cam 60 will commence to rotate and the pumps 72 will commence their suction stroke. In order to assure that the shafts 65, 70 will always stop in the same position corresponding to the commencement of the suction stroke, a further cam (not shown) may be provided on this shaft connection 65, 70 which opens the microswitch (not shown) of a holding circuit so that when the on-off switch 144 is opened to stop operation, the motor 140 will always stop in the same position corresponding to the beginning of the suction stroke. A further so-called purging switch may also be provided in a purging circuit to selectively actuate a solenoid valve opening a line connected with a source of, for example, $CO_2$ under pressure for purging the fluid lines and nozzles.

As mentioned before, closing of the main switch 102 will also permit to turn on the on-off switch (not shown) for the motor 130 driving the feed screw 30 whereby it is only necessary to adjust the speed of motor 130 by its variable speed control 131 (FIG. 1) to make sure that the required number of containers is fed to their respective filling positions before completion of the suction strokes of the pump. This can be readily achieved by the variable speed control 131 for motor 130 and by the speed control 141 associated with motor 140.

As the motors 110, 130 and 140 are thus energized by closing the respective switches, the machine will commence to operate according to the programmed cycle as determined by the setting in the counter 150. Each time the worm shaft 38 completes one revolution, the microswitch 172 is closed, thereby applying a pulse to the counter 150 which counts the number of pulses. Upon completion of the six revolutions, the counter 150 causes the clutch coil 161 to be de-energized by de-energizing the coil 176 of the relay 175 whereupon the shaft 33 is disconnected from the motor 130 and the feed screw 30 stops with six bottles properly positioned underneath the filling nozzles 50. In the meantime the drive connection 65, 70, suitably reduced in relation to the rotational speed of the motor 140 by conventional means, has caused the pumps 72 to carry-out their suction stroke and the cam 60 eventually causes the lowering of the filling nozzles 50 into the containers 20 after the feed screw 30 is stopped. By proper correlation of the various parts, the pumps 72 will start their power stroke as soon as the filling nozzles 50 reach their lowest position within the containers, thereby dispensing fluid into the containers 20 while cam 60, by suitable configuration of the guide groove 61, now starts to raise again the filling nozzles 50. The worm 38 continues to be stationary since the clutch brake 32 continues to be de-energized. The power strokes of the pumps 72 is completed prior to the point where the filling nozzles 50 clear the top of the containers. As soon as the cam 60 has caused the filling nozzles 50 to clear the top of the containers, the cam 181 causes the microswitch 182 to close, thereby applying a pulse to the counter 150 which signals that the containers have been filled and the nozzles have been raised sufficiently and causing re-energization of the coil 176 which in turn will, cause re-energization of the clutch coil 161, whereupon the clutch brake 32 will re-establish the drive connection between the motor 130 and the drive shaft 33. The worm shaft 38 will now resume its rotation, causing the feed screw 30 to discharge the filled containers as a result of its rotation while at the same time bringing in a new supply of containers into the proper position for the next filling operation. The next filling operation will commence again as soon as the predetermined number of revolutions have been completed by the feed screw 30 as determined by the closing of the microswitch 172 and as counted by the counter 150.

In case the nozzle support structure encounters any obstruction in its vertical movements, the energizing circuit for coil 107 of the power relay 106 is opened by the microswitch 114 thereby stopping the filling machine. The machine will also be automatically stopped if the scanner 80 detects the absence of a bottle near the in-feed point and/or if the scanner detects a back-up of bottles at the outlet end of the filling machine.

The operation may thus be summarized briefly as follows: Upon starting to operate the filling machine by closing the main switch 102 and the respective on-off switches, the motors 110, 130 and 140 will start to operate continuously whereas the feed screw 30 will rotate only a predetermined number of revolutions, as determined by the setting of the counter 150, will then stop while the filling operation takes place after the lowering of the filling nozzles 50 into the containers, and will resume to rotate upon closing of the microswitch 182 which signals to the counter 150 that the filling operation has been completed and the nozzles 50 have cleared the top of the containers.

If the pumps have, for example, a capacity of 16 oz., yet it is desired to fill containers with 32 oz. of fluid, it is only necessary to set the counter 150 to "three", whereby each containers will be filled twice with 16 oz. of fluid as the operating cycle now involves only three revolutions of the feed screw 30. This demonstrates the versatility of the instant invention by permitting the filling of containers with different amounts of fluid notwithstanding the fixed pump capacity.

Figures 3, 4:
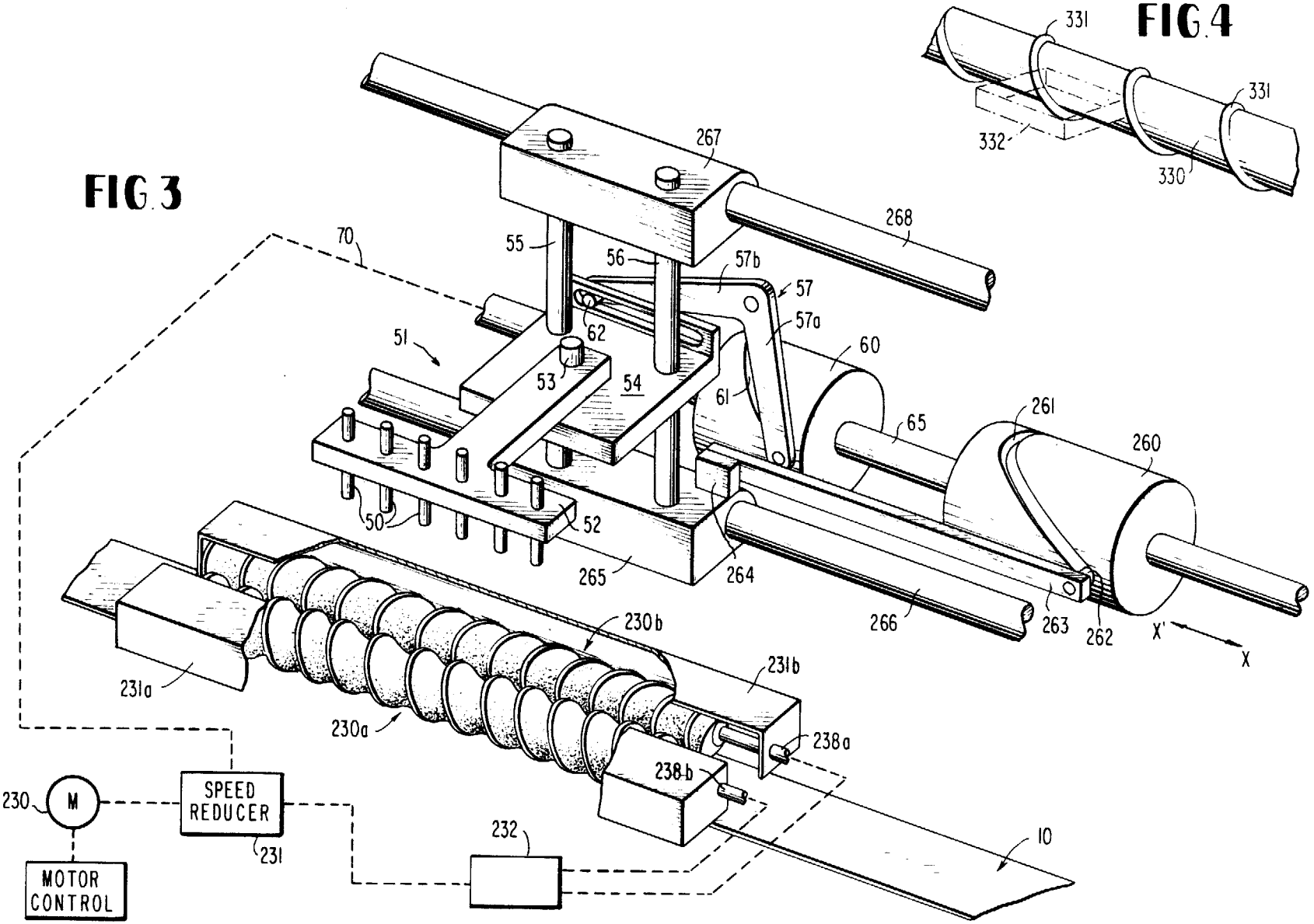
FIG. 3 is a modified embodiment of a filling machine in accordance with the present invention utilizing a walking beam nozzle support.
FIG. 4 is a still further modified embodiment of a feed screw filling machine in accordance with the present invention for use with rectangular containers having hinged lids.

The embodiment of FIG. 3 is substantially similar to the embodiment of FIG. 1 and similar reference numerals are applied. However, differing from FIG. 1, the embodiment of FIG. 2 utilizes two oppositely rotating feed screws generally designated by reference numerals 230*a* and 230*b* replacing the feed screw 30 of FIG. 1 cooperating with a guide 39. The feed screws 230*a* and 230*b* are provided with helices of opposite directions, i.e., with a left and right hand screw and are caused by conventional means to rotate in opposite directions by actuating the shafts 238*a* and 238*b* to rotate in opposite directions.

In addition to cam 60 which provides for the up and down motion of the nozzle support mechanism 52, 53 and 54 along rods 55 and 56 by way of the bell crank 57 guided in guide groove 61, a further cam 260 is mounted on the same shaft 65 which causes the nozzle support structure 52, 53, 54 to move in the direction of the conveyor 10, thereby providing in effect a walking beam filler. The cam 260 is provided with a guide groove 261 into which engages a guide pin 262 mounted on a member 263 which is rigidly connected by way of a member 264 with a support member 265 carrying the upright rods 55 and 56. The member 265 itself is longitudinally displaceably guided on a rod 266 which is suitably fixed on the machine by appropriate means (not shown). The upper ends of vertical guide rods 55 and 56 are fixedly held in a further support member 267 which is longitudinally slidable on a fixed guide rod 268, whereby guide rods 266 and 268 thus provide a parallel guidance. As is quite apparent from FIG. 3, the guide pin 262, will cause the assembly 263, 264, 265 and therewith rods 55 and 56 as well as the nozzle support structure 54, 53 and 52 to reciprocate in the direction X–X′ as it follows in guide groove 261. The guide groove 261 is thereby of such configuration that the speed of movement in the direction X is the same as the feed of the containers 20 by means of the feed screws 230*a* and 230*b* and such movement commences as soon as the nozzles 50 are lined upon with the containers 20 after the nozzles 50 return to their end position in the direction X′. As will become more apparent hereinafter, the arrangement of FIG. 3 greatly simplifies the control system since it dispenses with the need of stopping the feed screws 230*a* and 230*b*.

In the embodiment of FIG. 3, in addition to the motor 110 (not shown) for the conveyor, only one motor 230 is required which drives by way of a suitable speed reducer 231 the shaft connection 65, 70 for the pump actuation and the rotation of the cams 60 and 260, on the one hand, and the worm shafts 238*a* and 238*b*, on the other. Of course, intermediate the speed reducer 231 and the worm shafts 238*a* and 238*b* suitable means of conventional construction are provided to obtain the opposite rotational drives for the two worm shafts 238*a* and 238*b*, possibly by further speed reductions which may include, for example, chain and sprocket drives as described in connection with FIG. 1. Since such means are known in the art, they are designated by reference numeral 232. Additionally, appropriate controls may again be provided for the motor 230 including circuit breakers, an on-off switch and a variable speed control as well as means to stop the motor normally in the position in which the shaft connection 65, 70 is in a position corresponding to the beginning of the suction stroke of the pumps. Since such means are again conventional, they are not illustrated in detail herein.

As is quite apparent from FIG. 3, the control circuit of FIG. 2 is obviated by the walking beam arrangement of FIG. 3 in which the nozzle structure 51, 52, 53, 54, 55 and 56 is caused to reciprocate in the directions X–X′ during each filling cycle.

More particularly, in operation the predetermined number of containers, for example, six are again fed into the filling position underneath the nozzles 50 which had been moved back to the left-most starting position by a fast return in the direction X′ during the previous cycle by engagement of follower 262 on groove 261. The nozzles 50 will now be lowered as a result of the configuration of the guide groove 61 and owing to the particular configuration of guide groove 261, will travel at the same time in the direction X at the same speed as the containers which continue to be moved in the same direction by the feed screws 238*a* and 238*b*. This movement of the containers and of the nozzles 50 will continue while the nozzles 50 are being lowered by the configuration of groove 61 to near the bottom of the containers at which point the pumps will carry out their power stroke while the nozzles are being raised again. Once the power stroke of the pumps is completed and the nozzles have cleared the top of the containers as a result of the action of the guide groove 61, the guide groove 261 by its shape, will now cause a relatively rapid return in the direction X′ of the nozzles 50 so that they are again in position to be lowered into the next set of containers while the movement of the nozzles 50 in the direction X, as described above, again commences. Since the feed screws 230*a* and 230*b* now no longer need to be stopped during the filling operation, the rate of production is greatly increased and the control system is simplified as it dispenses with a counter and associated electromechanical control components.

FIG. 4 illustrates a particular application of the indexing mechanism of this invention to rectangular containers with hinged lids by the special shape of the feed screw 330 in which the helical rib portions 331 are relatively narrow with such a pitch as to provide sufficient spaces between adjoining helical surfaces to accommodate the relatively flat rectangular containers provided with a hinged lid, indicated in dash and dot lines and designated by reference numeral 332. Of course, two oppositely rotating feed screws may also be used again in this arrangemment.

The walking beam arrangement of FIG. 3 can be used, not only in connection with the indexing mechanism utilizing the feed screw as described in the various embodiments herein, but can also be utilized with any other filling machine in which the containers are indexed by other means, such as disclosed in my aforementioned patents. The use of a walking beam arrangement for the support structure of the filler nozzles will in every case significantly increase the rate of production and simplify the control.

While for purposes of simplicity of showing and description the raising and lowering mechanism of FIG. 1 is of the same type as that shown in connection with FIG. 3, it is preferred in actual practice to use a raising and lowering mechanism as descirbed in my prior U.S. Pat. No. 3,322,167 in connection with machines that do not involve a walking beam arrangement.

While I have shown and described only several embodiments in accordance with the present invention, it is understood that the same is not limited thereto but is susceptible of numerous changes and modifications as known to those skilled in the art. For example, the present invention is not limited to circular or rectangular containers with or without hinged lid but may also be used in connection with containers of any odd shape, whether or not equipped with a hinged hood which can be filled with a fluid by the filling machine in accordance with the present invention. Additionally, the walking beam filler illustrated in connection with FIG. 3 is not limited in its use to the indexing mechanism utilizing a feed screw but as mentioned above may be used to similar advantages with other indexing mechanisms. Accordingly, I do not wish to be limited to the details shown and described herein but intend to cover all such changes and modifications as are encompassed by the scope of the appended claims.

I claim:

1. A fluid handling and filling machine for filling containers with a predetermined amount of fluid, comprising pump means, nozzle means operatively connected with the pump means, first means for actuating the pump means, second means for raising and lowering the nozzle means, indexing means for indexing a predetermined number of containers to be properly positioned in relation to the nozzle means to enable filling of the containers by said nozzle means, said indexing means including at least one rotatable feed screw means defining indexing spaces for the containers and operable, upon rotation, to move the containers, and control means, operatively connected with both said first and second means and with said indexing means, for correlating the movement of containers by controlled rotation of the rotatable feed screw means of said indexing means to the filling thereof by said pump means and the lowering and raising of the nozzle means, said control means including counter means for counting the number of revolutions of the feed screw means, and further means for effectively stopping the feed screw means upon completion of a predetermined number of revolutions.

2. A machine according to claim 1, wherein said control means includes means for detecting the absence of a bottle near the in-feed point of the feed screw means.

3. A machine according to claim 2, wherein said control means includes means for detecting the back-up of bottles at the outlet and of the feed screw means.

4. A machine according to claim 3, wherein said both detecting means include photoelectric means operable to detect the presence and absence of a light beam.

5. A machine according to claim 4, wherein the photoelectric means of said first-mentioned detecting means is operable to stop the first means for actuating the pump means in the absence of an interruption of the light beam for a predetermined interval.

6. A machine according to claim 5, wherein the photoelectric means of the second detecting means is operable to detect the interruption of the light beam for a predetermined period of time.

7. A machine according to claim 6, further comprising conveyor means for conveying the containers to the in-feed point of the feed screw means and for removing the containers at the outlet end of the feed screw means.

8. A machine according to claim 7, wherein the pump means have suction and power strokes, and wherein said control means includes restarting means for restarting the rotation of the feed screw means when the pump means reach their respective position near the beginning of the suction stroke.

9. A machine according to claim 8, wherein said restarting means includes a cam on a shaft driving the pump means which is operable to close a microswitch, thereby applying a pulse to the counter means signalling the position of the pump shaft where the filling operation is completed and the nozzle means have been raised to clear the top of the containers.

10. A machine according to claim 9, in which a control circuit means for effectively energizing the first means for actuating the pump means includes switch means for de-energizing the first means in case of detection of a fault signal by said detecting means.

11. A machine according to claim 9, in which the control means includes a first cam means operable to lower the nozzle means toward the end of the suction stroke and to raise the nozzle means so as to clear the containers after completion of the power stroke of the pump means.

12. A machine according to claim 7, wherein said pump means have suction and power strokes, and wherein said control means includes a means operable to move the nozzle means in the direction of the containers and at the speed of the latter during the lowering of the nozzle means into the containers, during the power stroke of the pump means and during the raising of the nozzle means and to thereafter return the nozzle means in the opposite direction to the original starting position, the return movement of the nozzle means being more rapid than the movement in the direction of the containers.

13. A machine according to claim 1, in which said pump means have suction and power strokes, in which the control means includes a first cam means operable to lower the nozzle means toward the end of the suction stroke and to raise the nozzle means so as to clear the containers after completion of the power stroke of the pump means, and in which said control means also includes a second cam means operable to move the nozzle means in the direction of the containers and at the speed of the latter during the lowering of the nozzle means into the containers, during the power stroke of the pump means and during the raising of the nozzle means by said first-mentioned cam means and to thereafter return the nozzle means in the opposite direction to the original starting position.

14. A machine according to claim 13, wherein the return movement of the nozzle means is more rapid than the movement in the direction of the containers.

15. A machine according to claim 13, wherein said first and second cam means are operable to rotate at the same speed as shaft means for actuating the pump means.

16. A machine according to claim 1, with pump means having suction and power strokes, wherein said control means includes restarting means for restarting the rotation of the feed screw means when the pump means reach their respective position near the beginning of the suction stroke.

17. A machine according to claim 16, wherein said restarting means includes a cam on a shaft driving the pump means which is operable to close a microswitch, thereby applying a pulse to the counter means signalling the position of the pump shaft where the filling operation is completed and the nozzle means have been raised to clear the top of the containers.

18. A machine according to claim 17, in which said pump means have suction and power strokes, in which the control means includes a first cam means operable to lower the nozzle means toward the end of the suction stroke and to raise the nozzle means so as to clear the containers after completion of the power stroke of the pump means, and in which said control means also includes a means operable to move the nozzle means in the direction of the containers and at the speed of the latter during the lowering of the nozzle means into the containers, during the power stroke of the pump means and during the raising of the nozzle means and to thereafter return the nozzle means in the opposite direction to the original starting position.

19. A machine according to claim 18, wherein the return movement of the nozzle means is more rapid than the movement in the direction of the containers.

* * * * *

UNITED STATES PATENT OFFICE

CERTIFICATE OF CORRECTION

Patent No. 4,004,620 Dated January 25, 1977

Inventor(s) Sidney Rosen

It is certified that error appears in the above-identified patent and that said Letters Patent are hereby corrected as shown below:

In the Claims:

Cancel claims 12, 13, 14, 15, 18 and 19 in their entirety.

Signed and Sealed this

Fourteenth Day of June 1977

[SEAL]

*Attest:*

RUTH C. MASON
*Attesting Officer*

C. MARSHALL DANN
*Commissioner of Patents and Trademarks*